US010455859B2

(12) United States Patent
Powell

(10) Patent No.: US 10,455,859 B2
(45) Date of Patent: Oct. 29, 2019

(54) APPARATUSES FOR DISPENSING AND CUTTING SMOKING WRAPPERS AND METHODS FOR USING THE SAME

(71) Applicant: Lee L. Powell, San Antonio, TX (US)

(72) Inventor: Lee L. Powell, San Antonio, TX (US)

( * ) Notice: Subject to any disclaimer, the term of this patent is extended or adjusted under 35 U.S.C. 154(b) by 208 days.

(21) Appl. No.: 14/923,895

(22) Filed: Oct. 27, 2015

(65) Prior Publication Data

US 2017/0112184 A1 Apr. 27, 2017

(51) Int. Cl.

| | |
|---|---|
| ***A24C 5/00*** | (2006.01) |
| ***A24F 17/00*** | (2006.01) |
| ***B65H 35/00*** | (2006.01) |
| ***B26D 1/08*** | (2006.01) |

(52) U.S. Cl.

CPC ..... *A24C 5/002* (2013.01); *A24F 17/00* (2013.01); *B26D 1/085* (2013.01); *B65H 35/0026* (2013.01)

(58) Field of Classification Search

CPC ..... A24C 5/002; A24F 17/00; Y10T 225/295; Y10T 225/257; Y10T 225/269; Y10T 83/896; B26D 2210/11; B26D 1/085; B65H 35/06; B65H 35/04; B65H 35/002; B65H 35/0026; B65H 35/008; B65H 35/0086

See application file for complete search history.

(56) References Cited

U.S. PATENT DOCUMENTS

| | | | | |
|---|---|---|---|---|
| 2,862,676 | A * | 12/1958 | Castelli | B65H 35/0026 83/610 |
| 3,349,979 | A * | 10/1967 | Costello | B65H 35/0026 225/44 |
| 3,762,261 | A * | 10/1973 | Ekenberg | B65H 35/002 225/43 |
| 4,793,536 | A * | 12/1988 | Urushizaki | B65H 35/0086 225/22 |
| 6,386,416 | B1 * | 5/2002 | Dunshee | B65H 35/0026 225/43 |
| 9,113,658 | B1 * | 8/2015 | Sinclair, Jr. | A24C 5/46 |
| 2006/0118589 | A1 * | 6/2006 | Arnarp | B65H 35/002 225/43 |
| 2011/0114689 | A1 * | 5/2011 | Liu | B26F 3/02 225/39 |
| 2013/0313146 | A1 * | 11/2013 | Idheileh | A24F 17/00 206/449 |
| 2015/0216227 | A1 * | 8/2015 | Franklin | A24D 3/06 221/92 |
| 2017/0022023 | A1 * | 1/2017 | Littlejohns | B65H 35/002 |

* cited by examiner

*Primary Examiner* — Evan H MacFarlane

(74) *Attorney, Agent, or Firm* — Scherrer Patent & Trademark Law, P.C.; Stephen T. Scherer; Monique A. Morneault

(57) ABSTRACT

Apparatuses for dispensing and cutting smoking wrappers, such as tobacco wrappers and the like for use in smoking articles includes a dispensing roll for smoking wrappers and a cutting device useful for cutting the smoking wrappers. Methods for using the same are further provided.

9 Claims, 4 Drawing Sheets

APPARATUSES FOR DISPENSING AND CUTTING SMOKING WRAPPERS AND METHODS FOR USING THE SAME

TECHNICAL FIELD

The present invention relates to apparatuses useful for dispensing and cutting smoking wrappers, such as tobacco wrappers and the like for use in smoking articles. More specifically, the present invention comprises a dispensing roll for smoking wrappers and a cutting device useful for cutting the smoking wrappers. Methods for using the same are further provided.

BACKGROUND

Tobacco and other materials have been smoked for millennia. Typically, smoking articles take the shape of cylindrical articles having tobacco or other smoking material therein. The cylindrical articles typically comprise a combustible wrapper disposed on an outside thereof that may be burned, along with the smoking article, and inhaled by a user. Thus, the smoking articles may be delivery mechanisms for chemicals contained therein, such as nicotine and other like substances.

Tobacco products may take the form of cigars or cigarettes. Cigars are typically long and relatively wide cylindrically-shaped articles that are tightly rolled and bundled with a tobacco wrapper, typically a form of tobacco leaf, that is filled with dried and fermented tobacco leaves. Cigarettes are relatively thin, cylindrically-shaped or tubular smoking articles, typically comprising finely cut and dried tobacco leaves wrapped in a paper wrapper. Often, cigarettes have filters on one end, and may be packaged with fillers Most tobacco articles, such as cigars and cigarettes, may be purchased pre-rolled or pre-packaged, and the consumer is not required to prepare the smoking article him or herself. However, a certain segment of society still wishes to roll their own smoking articles. In such a case, a wrapper in the shape of a square or rectangle may be filled with smoking material, such as tobacco, and rolled together to form a cigar or cigarette. It is often difficult to maintain a store or supply of smoking article wrappers to be used in this regard. Typically, smoking article wrappers may be stored within a box or bag and pulled out when needed. A need, therefore, exists for smoking article wrappers that may be easily stored by a user for use when desired. Moreover, a need exists for smoking article wrappers that may be easily dispensed from a storage receptacle.

Oftentimes, smoking article wrappers may come in only one size. Therefore, a user who wishes to make a relatively large smoking article may have difficulty if the wrapper only comes as one size. Likewise, a user wishing to have a relatively small smoking article may require cutting a smoking article wrapper to achieve the relatively small smoking article. A need, therefore, exists for smoking article wrappers that may be relatively large for making relatively large smoking articles. Likewise, a need exists for smoking article wrappers that may be easily cut to form relatively small smoking articles.

In addition, typical smoking article wrapper containers, such as boxes or bags, require replacement when empty, and typically are thrown in the garbage. A need, therefore, exists for a smoking article wrapper container that holds a number of smoking article wrappers that may be retainer and refilled when empty. Moreover, a need exists for a smoking article wrapper container that may allow a user to easily replace with a quantity of smoking article wrappers when empty.

SUMMARY OF THE INVENTION

The present invention relates to apparatuses useful for dispensing and cutting smoking wrappers, such as tobacco wrappers and the like for use in smoking articles. More specifically, the present invention comprises a dispensing roll for smoking wrappers and a cutting device useful for cutting the smoking wrappers. Methods for using the same are further provided.

To this end, in an embodiment of the present invention, a smoking article wrapper dispenser comprising: a housing comprising a spindle configured to hold a roll of smoking article wrapper material as a continuous flat sheet; an opening in the housing configured to allow passage of the wrapper material from within the housing to outside the housing; a blade attached to a slidable block, the slidable block slidably disposed on a track on the outside of the housing, the slidable block disposed in proximity to the opening in the housing, wherein the blade is configured to cut the wrapper material when the wrapper material is disposed through the opening; and a blade housing adjacent the track configured to cover the blade when the block is slid adjacent the blade housing.

In an embodiment, the housing is cylindrically-shaped.

In an embodiment, the opening is through a round side of the cylindrically-shaped housing.

In an embodiment, the track is disposed on the round side of the cylindrically-shaped housing.

In an embodiment, the housing has a flat front face, and further wherein the opening is disposed in the flat front face.

In an embodiment, the track is disposed on the flat front face of the housing.

In an embodiment, the housing is bifurcated to provide access to the interior of the housing.

In an embodiment, the flat front face is removable from the remainder of the housing to provide access to the interior of the housing.

In an embodiment, the track comprises at least one slot and further wherein the block comprises a nub engaged with the slot on the track to allow the block to be slidable on the track.

In an embodiment. the smoking article wrapper dispenser further comprises: a textured pattern on the block, wherein the textured pattern is configured to allow a user to grip the block.

In an embodiment, the block is configured to cover the opening when the blade is covered by the blade housing.

In an embodiment, the smoking article wrapper dispenser further comprises: a roll of continuous smoking article wrapper material disposed on the spindle within the housing.

In an embodiment, the wrapper material has perforations configured to allow a user to manually remove a length of wrapper material from the roll.

In an alternate embodiment of the present invention, a method of using a smoking article wrapper dispenser is provided. The method comprises the steps of: providing a smoking article wrapper dispenser comprising a housing comprising a spindle configured to hold a roll of smoking article wrapper material as a continuous flat sheet, an opening in the housing configured to allow passage of the wrapper material from within the housing to outside the housing, a blade attached to a slidable block, the slidable block slidably disposed on a track on the outside of the housing, the slidable block disposed in proximity to the opening in the housing, wherein the blade is configured to cut the wrapper material when the wrapper material is disposed through the opening, a blade housing adjacent the track configured to cover the blade when the block is slid adjacent the blade housing, and a roll of continuous smoking article wrapper material within the housing; pulling a length of the smoking article wrapper material from the housing through the opening; and removing the length of the smoking article wrapper material from the remainder of the roll.

In an embodiment, the smoking article wrapper material comprises perforations, and the length of smoking article wrapper material is removed from the remainder of the roll by the step of: tearing the length of smoking article wrapper material at the perforations.

In an embodiment, the method further comprises the step of: sliding the block having the blade attached thereto so that the blade engages the smoking article wrapper material pulled through the opening and cuts the length of the smoking article wrapper material from the remainder of the roll.

In an embodiment, the housing is cylindrically-shaped, the opening is through a round side of the cylindrically-shaped housing, and the track is disposed on the round side of the cylindrically-shaped housing, the method further comprising the step of: sliding the block having the blade attached thereto so that the blade engages the smoking article wrapper material pulled through the opening and cuts the length of the smoking article wrapper material from the remainder of the roll.

In an embodiment, the housing has a flat front face, the opening is disposed in the flat front face, and track is disposed on the flat front face of the housing, the method further comprising the step of: sliding the block having the blade attached thereto so that the blade engages the smoking article wrapper material pulled through the opening and cuts the length of the smoking article wrapper material from the remainder of the roll.

In an embodiment, the block covers the opening when the blade is disposed in the blade housing.

In an embodiment, the method further comprises the step of: sliding the block over the opening and covering the blade by the blade housing.

It is, therefore, an advantage and objective of the present invention to provide smoking article wrappers that may be easily stored by a user for use when desired.

Moreover, it is an advantage and objective of the present invention to provide smoking article wrappers that may be easily dispensed from a storage receptacle.

In addition, it is an advantage and objective of the present invention to provide smoking article wrappers that may be relatively large for making relatively large smoking articles.

Likewise, it is an advantage and objective of the present invention to provide smoking article wrappers that may be easily cut to form relatively small smoking articles.

Further, it is an advantage and objective of the present invention to provide smoking article wrapper containers that hold a number of smoking article wrappers that may be retainer and refilled when empty.

Still further, it is an advantage and objective of the present invention to provide smoking article wrapper containers that may allow a user to easily replace with a quantity of smoking article wrappers when empty.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to apparatuses useful for dispensing and cutting smoking wrappers, such as tobacco wrappers and the like for use in smoking articles. More specifically, the present invention comprises a dispensing roll for smoking wrappers and a cutting device useful for cutting the smoking wrappers. Methods for using the same are further provided.

Figure 1:
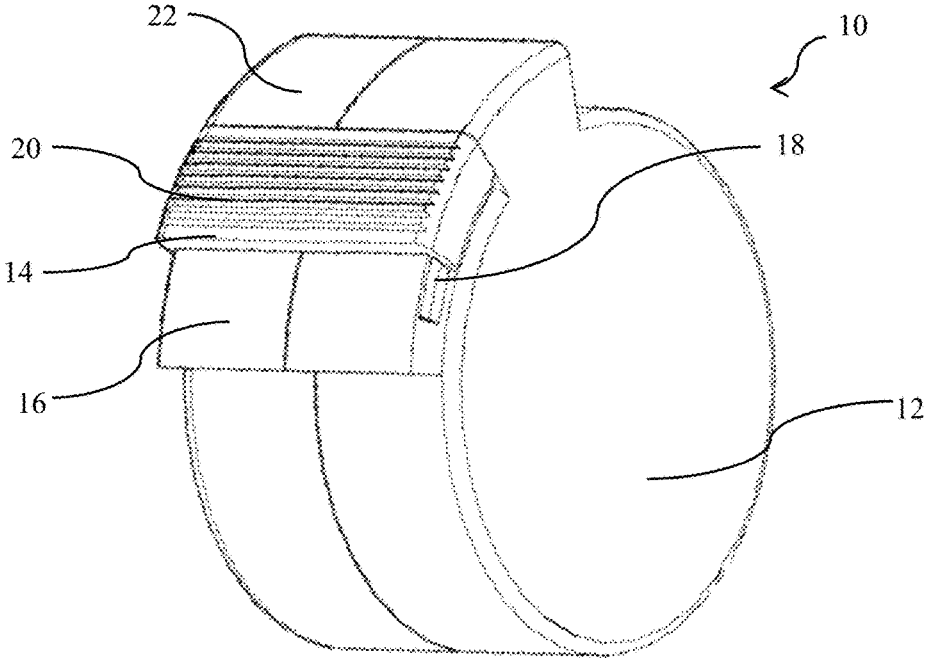
FIG. 1 illustrates a perspective view of a smoking article wrapper dispenser in an embodiment of the present invention.
Figure 4:
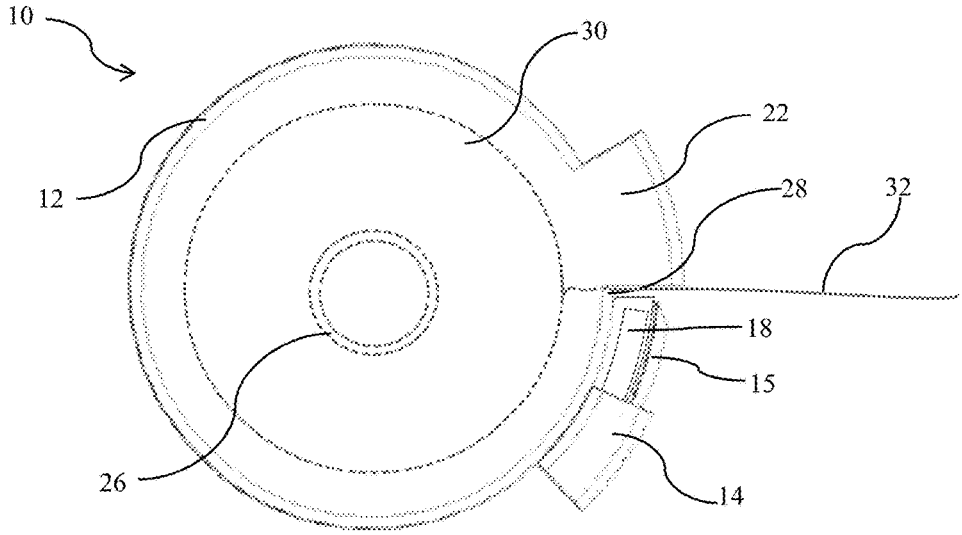
FIG. 4 illustrates a side view of a smoking article wrapper dispenser with a blade extended in an embodiment of the present invention.

Now referring to the figures, wherein like numerals refer to like parts, FIG. 1 illustrates a smoking article wrapper dispenser 10 in an embodiment of the present invention. The dispenser 10 comprises a housing 12 that may be in a cylindrical shape, although the shape of the housing should not be limited as described herein. The cylindrical housing 12 further comprises a cutting blade block 14 disposed on a track 16 that may be extended and retracted to expose a blade, as illustrated in FIG. 4. The track 16 may have one or more slots 18 on which the cutting blade block 14 may slide. The cutting blade block 14 may further have a patterned surface 20 on which a user's finger or thumb may engage to aid in sliding the cutting blade block 14 from a close position to an open position, and vice versa. A cutting blade housing 22 may be contained on the housing 12 to receive the cutting blade block 14 so that when not in use, the cutting blade 15 may be safely contained.

Figure 2:
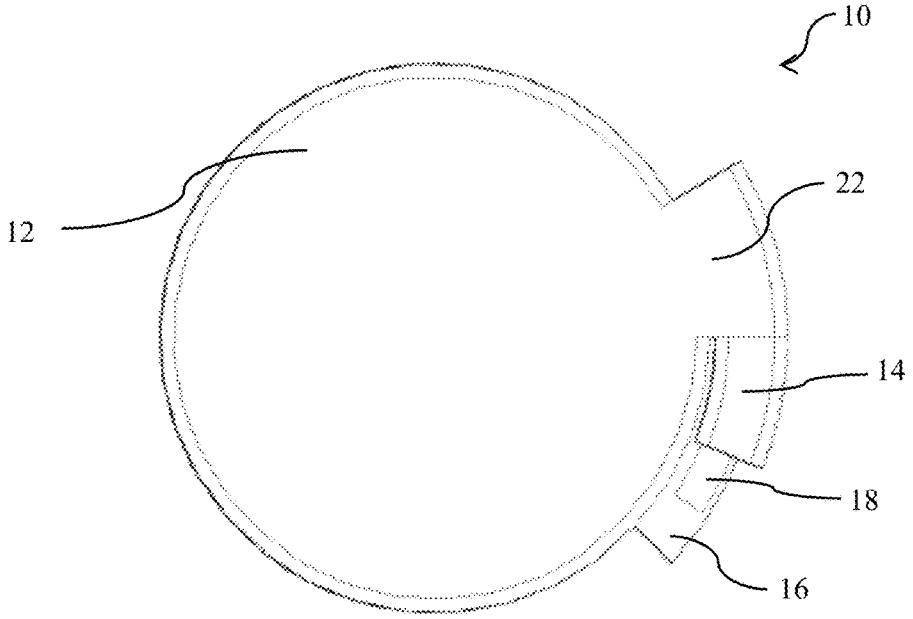
FIG. 2 illustrates a side view of a smoking article wrapper dispenser in an embodiment of the present invention.

FIG. 2 illustrates a side view of the dispenser 10, showing the housing 12 and the cutting blade block 14 retracted so that the blade is safely contained within the housing 22. The cutting blade block 14 is disposed on the track 16, and more specifically engages the slot 18, which allows the cutting blade block 14 to slide within the slot 18. One or more engaging nubs (not shown) may be disposed on the cutting blade block 14 for engaging with the slot 18 to allow the cutting blade block 14 to slide within the slot 18.

Figure 3:
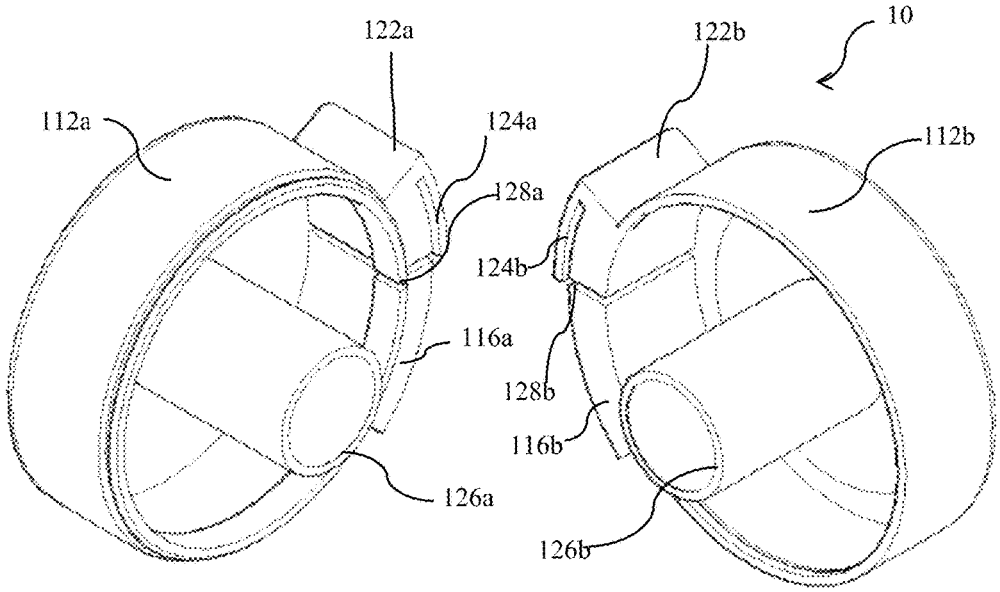
FIG. 3 illustrates an exploded view of a smoking article wrapper dispenser in an embodiment of the present invention.

As illustrated in FIG. 3, the housing 12, the track 16 and the housing 22 may be bifurcated, wherein the housing 12 comprises a first half 112*a* and a second half 112*b*. Likewise, the track 16 may have a first half 116*a* and a second half 116*b*, and the housing 22 may have a first half 122*a* and a second half 122*b*. Each half of the housing 122*a*, 122*b* may have halves of a slot 124*a*, 124*b* to receive the blade.

Disposed within the housing 12 may be a spindle, represented by halves 126*a*, 126*b*, each of which may extend from a side of each housing half 112*a*, 112*b*, respectively. The spindle halves 126*a*, 126*b* may engage one another when the housing halves 112*a*, 112*b* are placed together. Thus a roll of smoking article wrapper material may be placed on one of the spindle halves 126*a*, 126*b*, and the two housing halves 112*a*, 112*b* may be engaged to form the full housing 12, with the spindle halves 126*a*, 126*b* engaging each other.

As illustrated in FIG. 3, each housing half 126*a*, 126*b* may have an exit slot half 128*a*, 128*b* to form an exit slot 28 (as illustrated in FIG. 4) so that smoking article wrapper material may be pulled therethrough and cut by the cutting blade block 14. Specifically, FIG. 4 illustrates a side view of the dispenser 10 showing, in phantom, a roll of smoking article wrapper material 30 that may be disposed on spindle 26. A length of wrapper material 32 may be pulled and extend through slot 28 when the cutting blade block 14 is extended downwardly to expose the blade 15 by traversing the slot 18. After the desired length of wrapper material is extended from the dispenser 10, the cutting blade block 14 may be pushed upwardly and the blade 15 may cut through the wrapper material to allow the user to remove the desired length 32. Alternatively, the wrapper material may have perforations (not shown in FIG. 4) disposed laterally at regular lengths so that a user may manually pull apart the regular length of wrapper material, as desired.

Figure 5:
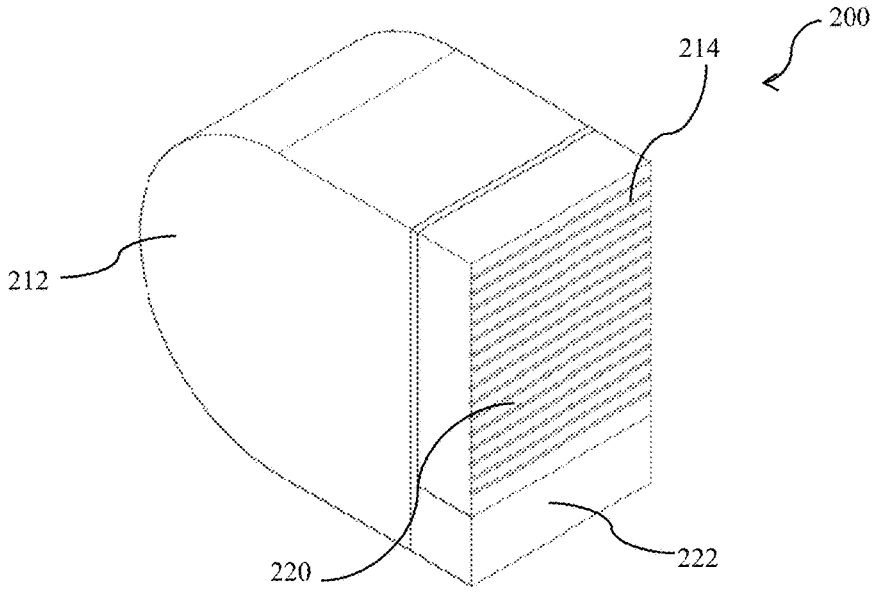
FIG. 5 illustrates a perspective view of a smoking article wrapper dispense in an alternate embodiment of the present invention.
Figure 6:
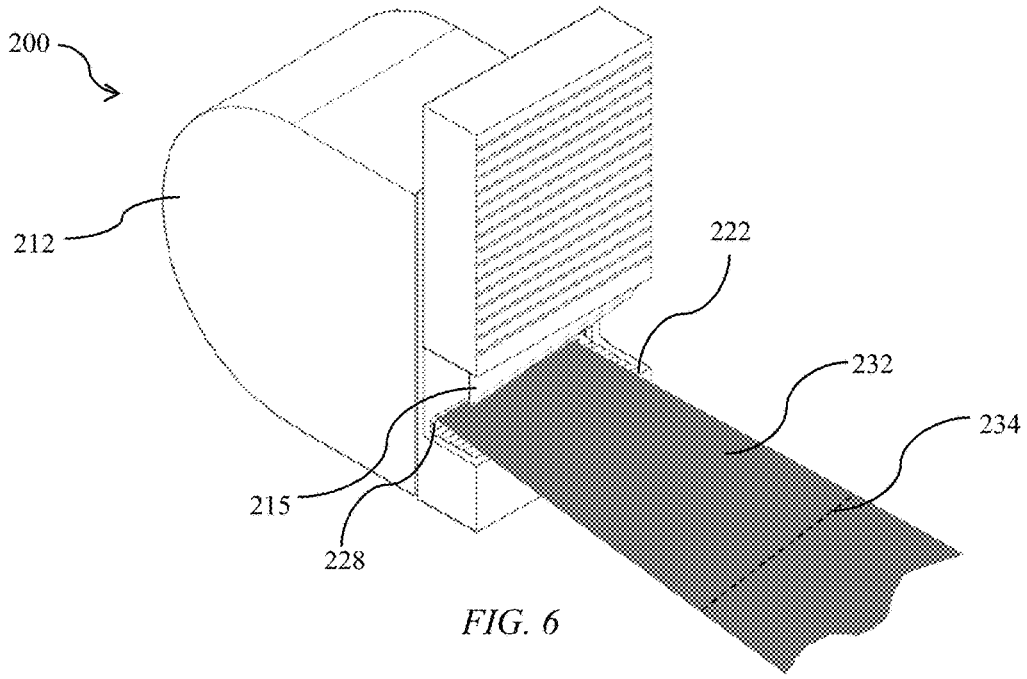
FIG. 6 illustrates a perspective view of a smoking article wrapper dispenser with a blade extended and exposed in an alternate embodiment of the present invention.

FIG. 5 illustrates an alternate embodiment of a smoking article wrapper dispenser 200. The dispenser 200 may have a housing 212 that may contain a rolled quantity of smoking article wrapper material. The housing 212 may be rounded in shape, although the precise shape is not meant to be limiting, with a square or rectangular front 213. Disposed on the front 213 of the housing 212 may be an extendible and retractable cutting blade block 214 that is similar to the cutting blade block 14 disclosed above. The cutting blade block 214 may contain a blade 215 (as illustrated in FIG. 6) that may be exposed when a user pushes upwardly on the cutting blade block 214 on the surface pattern 220. Once the cutting blade 215 is extended, as illustrated in FIG. 6, a length of smoking article wrapper material 232 may be withdrawn from the housing 212 through exit slot 228 and cut via the blade 215 by pushing downwardly on the cutting blade block 214. Alternatively, a regular length of wrapper material may be torn by a user manually via perforations 234 on the wrapper material.

The dispenser 200 may further have a blade housing 222 in which the blade 215 may be stored when disposed in a downward configuration to ensure safety so that the blade is not exposed when not in use.

Figure 7:
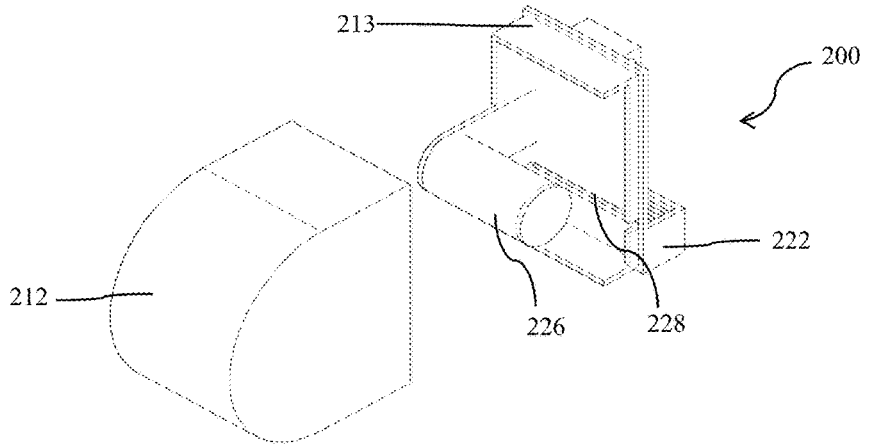
FIG. 7 illustrates a rear perspective exploded view of a smoking article wrapper dispenser with an alternate embodiment of the present invention.
Figure 8:
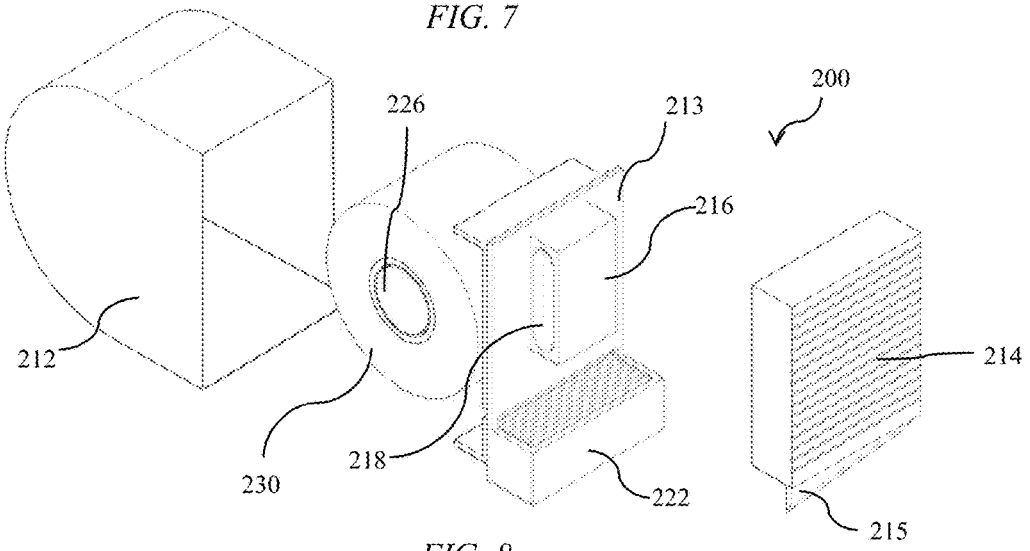
FIG. 8 illustrates a front perspective exploded view of a smoking article wrapper dispenser with an alternate embodiment of the present invention.

FIG. 7 illustrates an exploded view of dispenser 200, showing the housing 212 away from the front 213. Extending from the front 213 may be a spindle 226 for holding a roll of wrapper material, as illustrated in FIG. 8. The wrapper material may be pulled through exit slot 228 for cutting or otherwise separating the desired length, as described above. The housing 212 may be removed, as shown in FIGS. 7 and 8, and a roll of smoking article wrapper material may be placed on the spindle 226. The housing may then be placed over the front 213 to close up the same for use.

Figure 9:
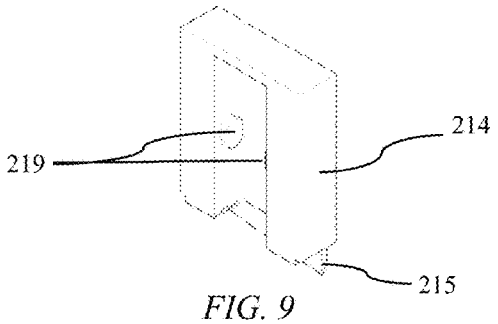
FIG. 9 illustrates a perspective view of a cutting apparatus having a blade in an alternate embodiment of the present invention.

FIG. 8 illustrates a front perspective exploded view showing the housing 212, a roll of wrapper material 230 disposed on the spindle 226, the front 213 having a track 216 for holding the cutting blade block 214. The track 216 may have one or more sliding slots 218 for holding the cutting blade block 214 thereon and allowing the cutting blade 214 to slide upwardly and downwardly. FIG. 9 illustrates internal nubs 219 that may engage the one or more sliding slots 218 so that the cutting blade block 214 may move upwardly and downwardly.

Thus, a user may pull a desired length of smoking article wrapper material from the dispenser 200 and either cut the same via the blade 215 or tear the same via perforations 234 (as illustrated in FIG. 6)

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A smoking article wrapper dispenser comprising:

a housing comprising a planar opening;

a planar face configured to removably fit within the planar opening of the housing, the planar face having a first flat side and a second flat side opposite the first flat side, the first flat side having a spindle extending therefrom and the spindle is positioned within the housing so that the spindle extends within the housing when the planar face is fit within the planar opening, the second flat side positioned external to the housing;

a roll of smoking article wrapper material disposed on the spindle;

a second opening in the planar face configured to allow passage of the smoking article wrapper material from within the housing to outside the housing, wherein the smoking article wrapper material is disposed through the second opening perpendicular to the planar face as a flat sheet;

a blade attached to a slidable block, the slidable block slidably disposed on a track on the second flat side of the planar face, the slidable block disposed in proximity to the second opening in the planar face wherein the blade slides with the slidable block perpendicular to the flat sheet of smoking article wrapper material, wherein the blade is configured to cut the flat sheet of smoking article wrapper material by sliding the blade through the flat sheet of smoking article wrapper material; and a blade housing adjacent the track and extending from the second flat side of the planar face, the blade housing comprising a surface that runs parallel to the flat sheet of smoking article wrapper material and a slot within the surface that runs perpendicular to the flat sheet of smoking article wrapper material, wherein the blade housing is configured to cover the blade when the block is slid and the blade enters the slot perpendicular to the flat sheet of smoking article wrapper material, and further wherein the flat sheet of smoking article wrapper material rests on the surface of the blade housing when the blade is slid through the flat sheet of smoking article wrapper material.

2. The smoking article wrapper dispenser of claim 1 wherein the planar face is removable from the housing to provide access to an interior of the housing.

3. The smoking article wrapper dispenser of claim 1 wherein the track comprises at least one slot and further wherein the block comprises a nub engaged with the slot on the track to allow the block to be slidable on the track.

4. The smoking article wrapper dispenser of claim 1 further comprising:

a textured pattern on the block, wherein the textured pattern is configured to allow a user to grip the block.

5. The smoking article wrapper dispenser of claim 1 wherein the block is configured to cover the second opening when the blade is covered by the blade housing.

6. The smoking article wrapper dispenser of claim 1 wherein the smoking article wrapper material has perforations configured to allow a user to manually remove a length of smoking article wrapper material from the roll.

7. A method of using a smoking article wrapper dispenser comprising the steps of:

providing a smoking article wrapper dispenser comprising a housing comprising a planar opening, a planar face configured to removably lit within the planar opening of the housing, the planar face having a first flat side and a second flat side opposite the first flat side, the first flat side having a spindle extending therefrom and the spindle is positioned within the housing so that the spindle extends within the housing when the planar face is fit within the planar opening, the second flat side positioned external to the housing, a second opening in the planar face wherein smoking article wrapper material is disposed through the second opening from within the housing to outside the housing as a flat sheet perpendicular to the planar face, a blade attached to a slidable block, the slidable block slidably disposed on a track on the second flat side of the planar face, the slidable block disposed in proximity to the second opening in the planar face and slidable parallel to the second flat side, wherein the blade slides with the slidable block perpendicular to the flat sheet of smoking article wrapper material and is configured to cut the wrapper material when the wrapper material is disposed through the second opening, a blade housing adjacent the track and extending from the second flat side of the planar face, the blade housing comprising a surface that runs parallel to the flat sheet of smoking article wrapper material when disposed through the second opening, the blade housing further comprising a slot within the surface that runs perpendicular to the flat sheet of smoking article wrapper material, wherein the blade housing is further configured to cover the blade when the block is slid and the blade enters the slot perpendicular to the flat sheet of smoking material;

pulling a length of the smoking article wrapper material as the flat sheet from the housing through the second opening wherein the flat sheet of smoking article wrapper material rests on the surface of the blade housing;

sliding the block having the blade attached thereto parallel to the second flat side so that the blade perpendicularly engages the smoking article wrapper material pulled through the second opening and cuts the length of the smoking article wrapper material from a remainder of the smoking article wrapper material and further wherein the blade enters the slot of the blade housing when the blade cuts the length of the smoking article wrapper material; and removing the length of the smoking article wrapper material from the remainder of the smoking article wrapper material.

8. The method of claim 7 wherein the smoking article wrapper material comprises perforations, and a second length of smoking article wrapper material is removed from the remainder of the smoking article wrapper material by the step of:

tearing the second length of smoking article wrapper material at the perforations.

9. The method of claim 7 wherein the block covers the second opening when the blade is disposed in the blade housing.

* * * * *